US007530202B2

(12) United States Patent
Ritchie et al.

(10) Patent No.: US 7,530,202 B2
(45) Date of Patent: May 12, 2009

(54) CLAMP FOR A GUY GUARD

(76) Inventors: Robert T. Ritchie, 14 Leamster Trail, Caledon East, Ontario (CA) L0N 1E0; John Robert Davies, 4 Willowgate Drive, Markham, Ontario (CA) L3P 1G2

( * ) Notice: Subject to any disclaimer, the term of this patent is extended or adjusted under 35 U.S.C. 154(b) by 159 days.

(21) Appl. No.: 11/471,086

(22) Filed: Jun. 20, 2006

(65) Prior Publication Data

US 2006/0283107 A1 Dec. 21, 2006

Related U.S. Application Data

(60) Provisional application No. 60/692,208, filed on Jun. 20, 2005.

(51) Int. Cl.
*E04H 12/20* (2006.01)

(52) U.S. Cl. ..... 52/147

(58) Field of Classification Search ..... 439/806; 52/147; 174/136; 24/135 K
See application file for complete search history.

(56) References Cited

U.S. PATENT DOCUMENTS 725,599 A * 4/1903 Smith ..... 24/135 K
863,461 A * 8/1907 Smithson ..... 279/106
3,010,546 A * 11/1961 Phillips ..... 52/147
3,897,664 A * 8/1975 Bogese, II ..... 52/147
3,999,340 A * 12/1976 Bogese et al. ..... 52/147
4,231,208 A * 11/1980 Willox ..... 52/741.3
5,119,607 A * 6/1992 Horning et al. ..... 52/147

OTHER PUBLICATIONS

R&M Plastic Products Ltd.; Shop drawing of product on the market; Feb. 25, 2003; produced by R&M Plastic Products Ltd., 55 Nuggett Ct.; Brampton, Ontario L6T 5A9 CA.

* cited by examiner

*Primary Examiner*—Neil Abrams
(74) *Attorney, Agent, or Firm*—Young Basile

(57) ABSTRACT

A guy guard assembly for use with a guy wire is disclosed. The assembly comprises a tubular guy guard and a clamp. The tube wall has an aperture. The clamp includes a bolt, a first plastic portion and a second plastic portion. The bolt has a head outside the tube and a threaded shaft extending from the head through the aperture. The first portion is inside the tube against the tube wall; has the bolt extending therethrough; and defines a first jaw. The second portion defines a second jaw and is threaded to the bolt. The portions have a first configuration, wherein the jaws are relatively distal to and spaced from one another to define a slot for said wire and, from the first configuration, are configurable by rotating the bolt to a second configuration, wherein the jaws are relatively proximal to one another to grip said wire.

17 Claims, 9 Drawing Sheets

CLAMP FOR A GUY GUARD

RELATED APPLICATION

This application is a utility application claiming priority to U.S. provisional application Ser. No. 60/692,208 filed on Jun. 20, 2005, currently pending. The content of the U.S. Patent Ser. No. 60/692,208 is incorporated herein by reference.

FIELD OF THE INVENTION

The present invention relates to the field of guy guards, and more particularly, to clamps therefor.

BACKGROUND OF THE INVENTION

It is well known to provide a guy wire with a guard. The purpose of the guard is to make the guy wire highly visible, so as to reduce the potential that passers-by will collide with the guy wire, and to reduce the severity of injuries flowing from collisions that do occur. To serve this purpose, a guard is often constructed out of highly-visible plastic and takes the form of a tube of sufficient length to wrap around that portion of the guy wire that is likely to be the subject of a collision, and of a diameter calculated to spread the force of a typical collision over a sufficient area to avoid serious injury. Guards often are about 5-7' long, and 3-5" in diameter.

Usually, that portion of the guy wire that is likely to be collided with is the portion nearest the ground. If the guard tube is not secured to the wire, it is possible for wind to carry the tube away from the ground, thereby dangerously exposing the lower portion of the wire. Accordingly, it is commonplace to immobilize the guy guard with respect to the guy wire. This has the added benefit of reducing the incidence of unlawful removal of the guards. Various immobilization systems are known in the art. A commonly used system involves a metal bolt and a pair of metal jaws, one having a threaded bore and the other having a clearance hole. The shaft of the bolt is slipped through a hole in the tube wall and through the clearance hole, and then threaded into the threaded bore. Using this system, an installer can fit the guy wire between the jaws and tighten the bolt to immobilize the wire. This system is known to be operable, but the metal components can be expensive. It can also be inconvenient to use, as the installer is required to simultaneously keep the guy wire and jaws properly arranged and tighten the bolt. A result of this inconvenience is that often installers fail to immobilize the guards, with consequential deleterious impacts on safety.

SUMMARY OF THE INVENTION

A guy guard assembly forms one aspect of the invention. The guy guard assembly is for use with a guy wire of the type secured in use at one end to a structure to be supported and at the other end to the ground. The guy guard assembly comprises a guy guard and a clamp. The guy guard takes the form of a tube, the tube wall having an aperture defined therethrough. The clamp includes a bolt, a first plastic clamp portion and a second plastic clamp portion. The bolt has a head disposed outside the tube and a threaded shaft extending from the head through the aperture. The first plastic clamp portion is disposed inside the tube against the tube wall, has the bolt extending therethrough in spaced-relation and defines a first jaw part. The second plastic clamp portion defines a second jaw part and is threaded to the bolt. The clamp portions have a first configuration, wherein the jaw parts are relatively distal to and spaced apart from one another to define a slot in which said guy wire can be slotted, and, from the first configuration, are configurable through rotation of the bolt to a second configuration, wherein the jaw parts are relatively proximal to one another to grip said guy wire when disposed in said slot.

A clamp for use with a guy guard tube forms another aspect of the invention. The tube is of the type through which a guy wire extends in use and having an aperture defined through the tube wall. The clamp includes a bolt, a first plastic clamp portion and a second plastic clamp portion. The bolt has a head disposed in use outside said guy guard and a threaded shaft extending from the head through said aperture in use. The first plastic clamp portion is disposed in use inside the tube against the tube wall, has the bolt extending therethrough in spaced relation and defines a first jaw part. The second clamp portion defines a second jaw part and is threaded to the bolt. The clamp portions have a first configuration, wherein the jaw parts are relatively distal to and spaced apart from one another to define a slot in which said guy wire can be slotted, and, from the first configuration, are configurable through rotation of the bolt to a second configuration, wherein the jaw parts are relatively proximal to one another to grip said guy wire when disposed in said slot.

A clamp forms another aspect of the invention. The clamp is for use with a guy guard tube of the type through which a guy wire extends in use and having an aperture defined through the tube wall. The clamp comprises a bolt, a first clamp portion, a second clamp portion and bias means. The bolt has a head disposed in use outside said guy guard tube and a threaded shaft extending from the head through said aperture in use. The first clamp portion is disposed in use inside the tube against the tube wall, has the bolt extending therethrough in spaced relation and defines a first jaw part. The second clamp portion defines a second jaw part and is threaded to the bolt. The clamp portions have a first configuration, wherein the jaw parts are relatively distal to and spaced apart from one another to define a slot in which said guy wire can be slotted, and, from the first configuration, are configurable through rotation of the bolt to a second configuration, wherein the jaw parts are relatively proximal to one another to grip said guy wire when disposed in said slot. The bias means is for biasing the clamp portions for movement toward the first configuration.

Advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, which drawings are briefly described hereinbelow.

Figure 1A:
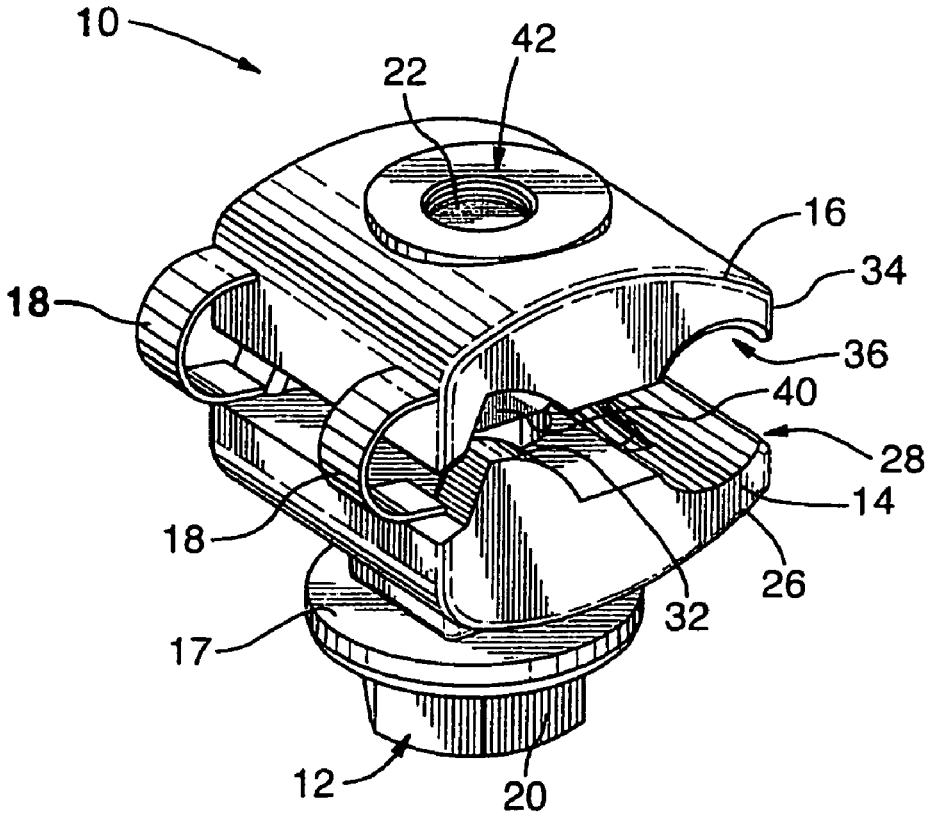
FIG. 1A is a perspective view of a clamp constructed according to a first preferred embodiment of the invention and shown in a first, open configuration.
Figure 1B:
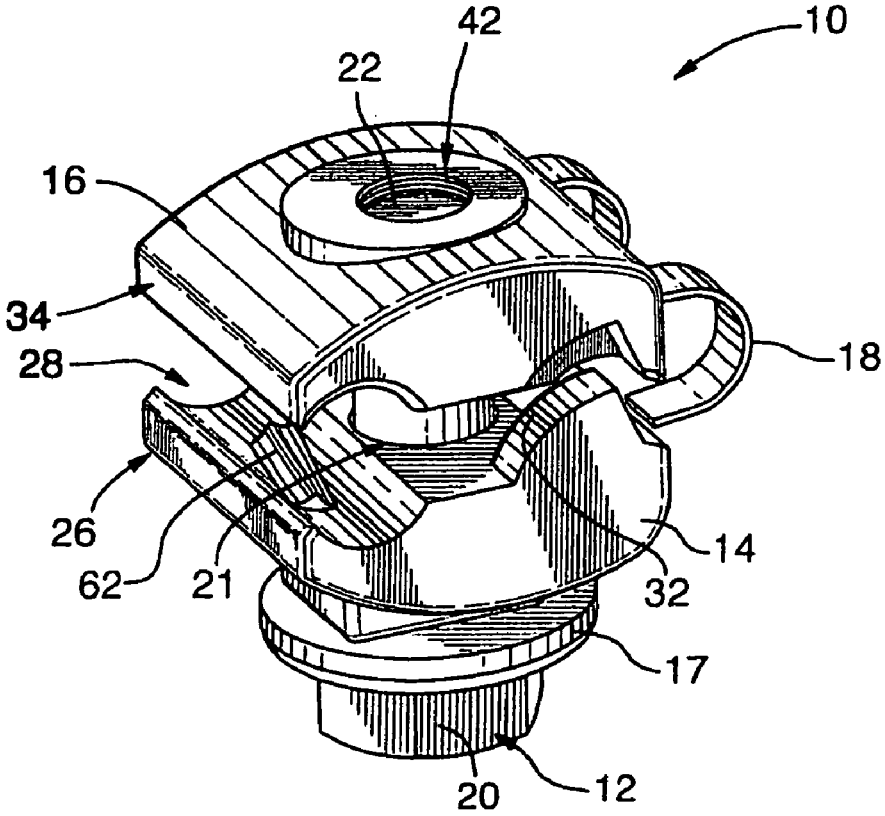
FIG. 1B is a perspective view of the structure of FIG. 1A from an opposing viewpoint.
Figure 1C:
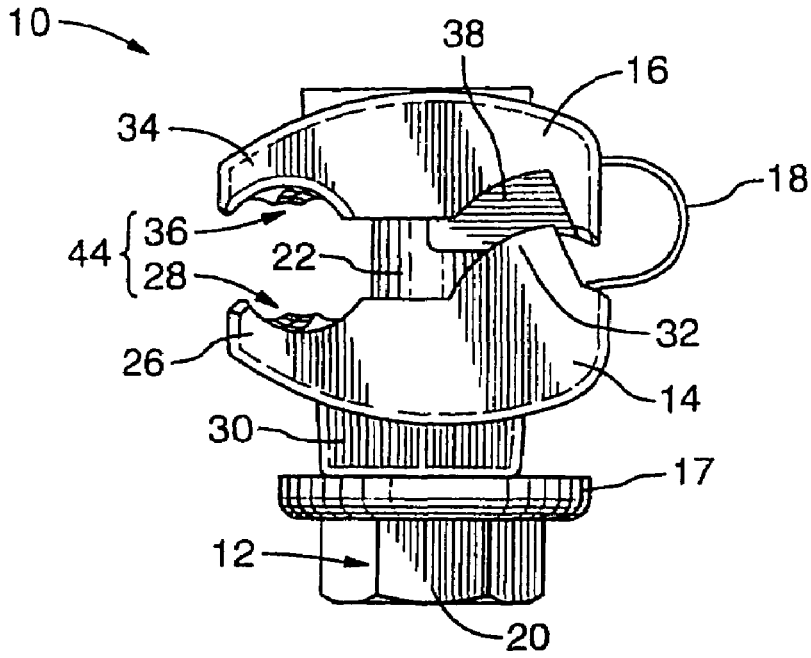
FIG. 1C is a side view of the structure of FIG. 1A.
Figure 1D:
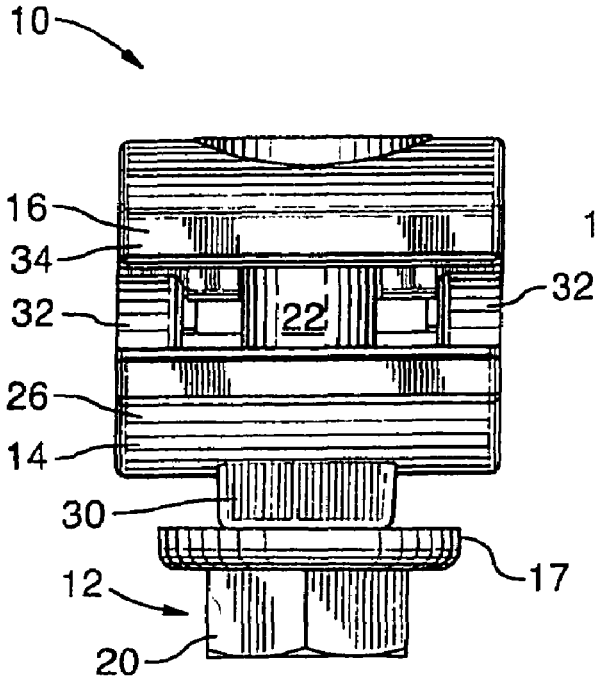
FIG. 1D is a front view of the structure of FIG. 1A.
Figure 1E:
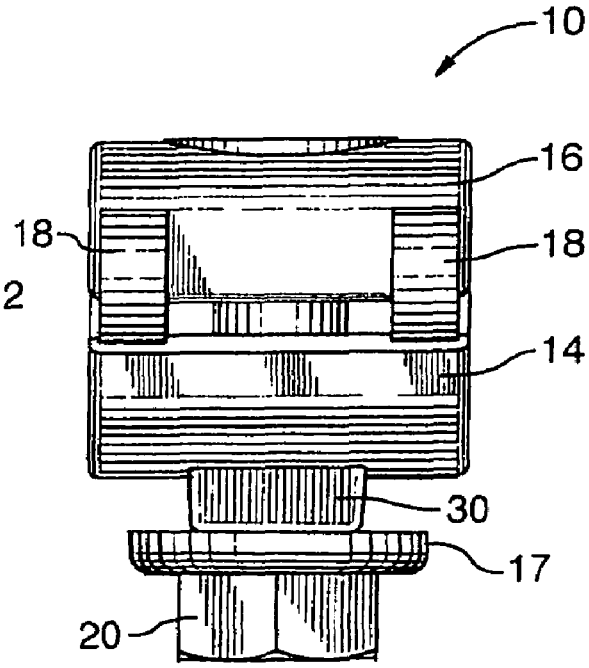
FIG. 1E is a rear view of the structure of FIG. 1A.
Figure 1F:
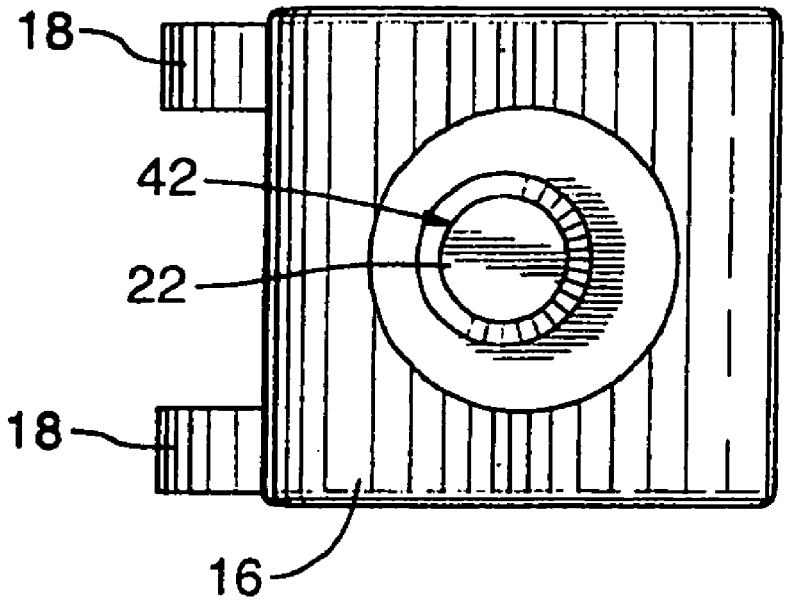
FIG. 1F is a top view of the structure of FIG. 1A.
Figure 1G:
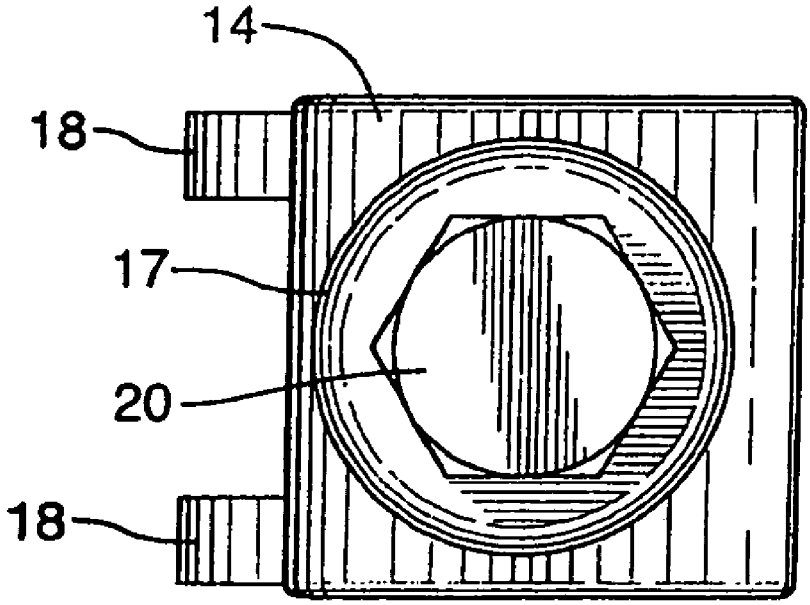
FIG. 1G is a bottom view of the structure of FIG. 1A.
Figure 2A:
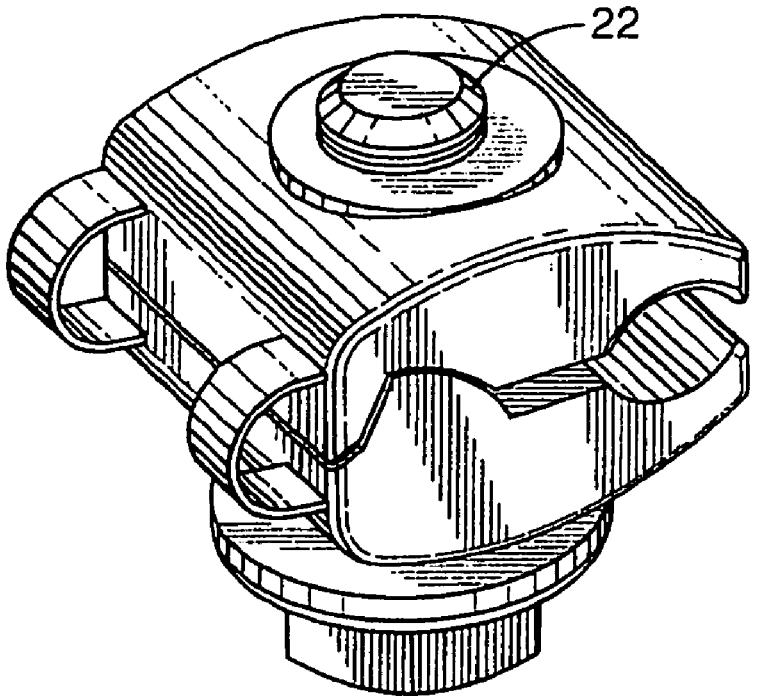
FIG. 2A is a view similar to FIG. 1A, with the clamp shown in a second, closed configuration.
Figure 2B:
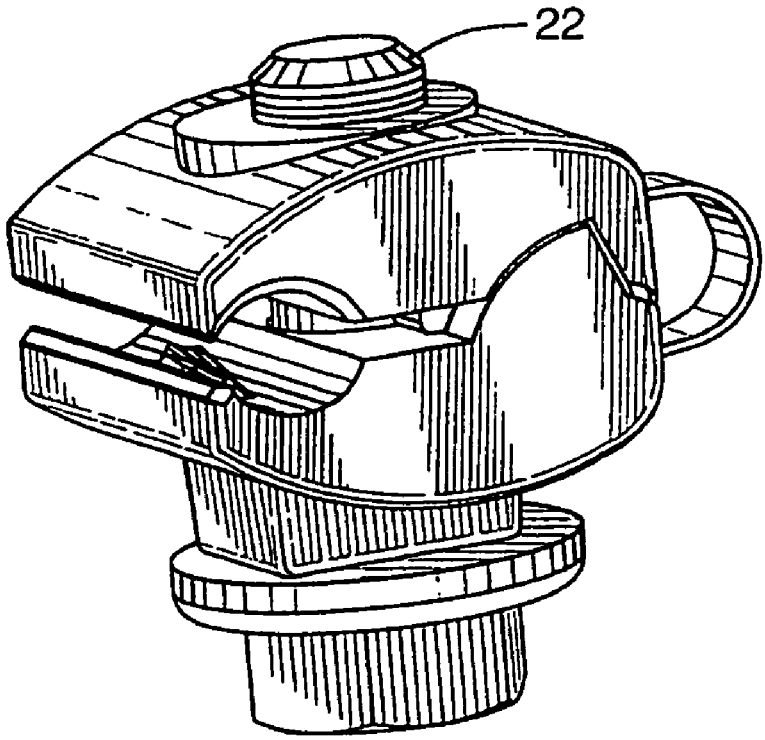
FIG. 2B is a perspective view of the structure of FIG. 2A from an opposing viewpoint.
Figure 2C:
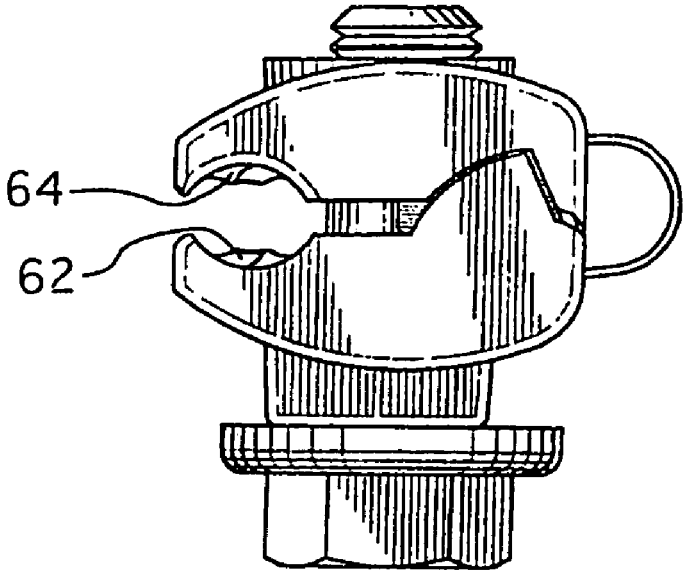
FIG. 2C is a side view of the structure of FIG. 2A.
Figure 2D:
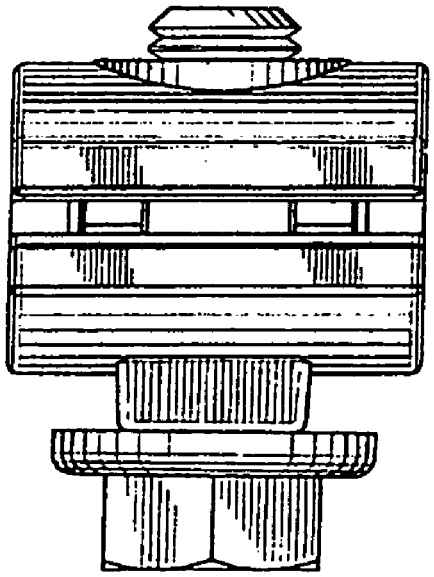
FIG. 2D is a front view of the structure of FIG. 2A.
Figure 2E:
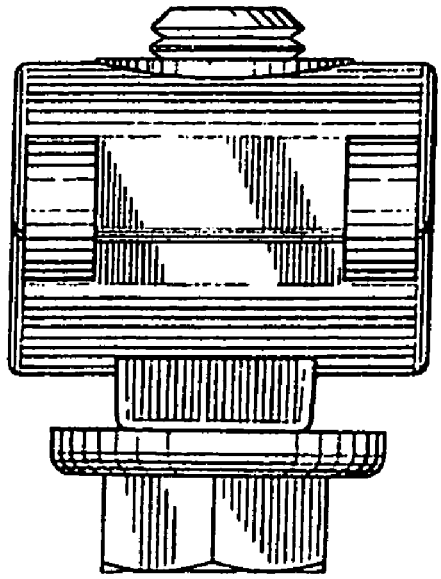
FIG. 2E is a rear view of the structure of FIG. 2A.
Figure 2F:
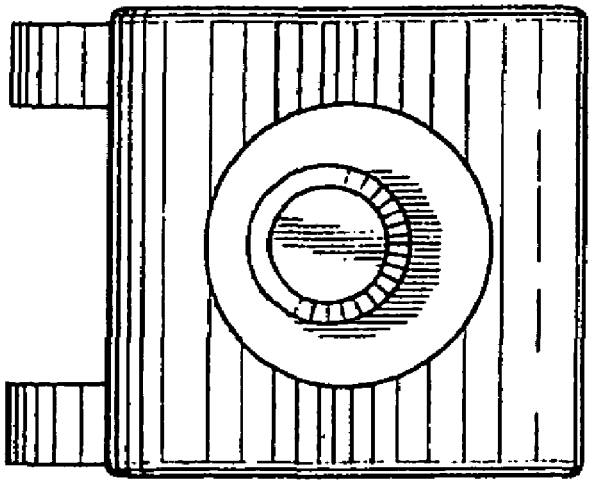
FIG. 2F is a top view of the structure of FIG. 2A.
Figure 2G:
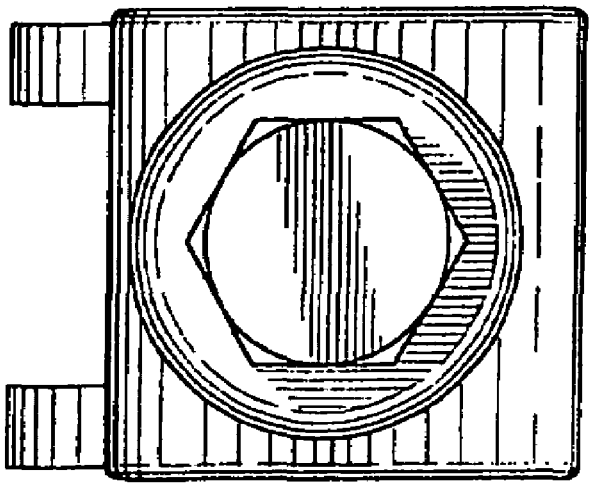
FIG. 2G is a bottom view of the structure of FIG. 2A.

With general reference to FIG. 1A, a preferred embodiment of the present invention, a clamp 10, is illustrated, and will be seen to include a bolt 12, a first clamp portion 14, a second clamp portion 16, a washer 17 and one or more resilient straps 18, specifically, a pair of resilient straps 18.

The bolt 12 is constructed of steel and has a hex head 20 and a threaded shaft 22 extending from the head 20. The washer 17 is constructed out of a durable, polymeric material, and is disposed around the shaft 22, adjacent the hex head 20.

The first clamp portion 14 is injection-molded integrally out of plastic that is substantially electrically non-conductive, specifically, 30% glass filled nylon, and, with general reference to FIGS. 1A-1G and 2C, has a bore 21 through which the bolt 12 extends in spaced relation, a first jaw part 26 defining a trough 28, a square protruding boss 30, a pair of protruding ears 32 and a first grip member 62 defined in the trough 28.

The second clamp portion 16 is also injection-molded out of 30% glass filled nylon, has a second jaw part 34 defining a trough 36 in which a second grip member 64 is defined, and is threaded on the shaft 22 such that the troughs 28, 36 of the first clamp portion 14 and second clamp portion 16 are opposed and such that the ears 32 projecting from the first clamp portion 14 mechanically engage opposite notches 38, 40 of the second clamp portion 16 so as to define arresting means for arresting relative rotation of the first clamp portion 14 and the second clamp portion 16 about the bolt 12. The second clamp portion 16 is threaded on the shaft 22 by means of a threaded bore 42 which extends through the second clamp portion 16.

The straps 18 are each connected to each of the first clamp portion 14 and the second clamp portion 16, and are constructed out of resilient, non-electrically conductive plastic.

The clamp portions have a first configuration shown in FIGS. 1A-1G, wherein the jaw parts 26, 34 are relatively distal to and spaced apart from one another to define a slot 44, and, from the first configuration, are configurable through rotation of the bolt 12 to a second configuration, shown in FIGS. 2A-2G, wherein the jaw parts 26, 34 are relatively proximal to one another. The resilient straps 18 are sprung so as to define means for biasing the clamp portions 14, 16 towards the first configuration.

Figure 3A:
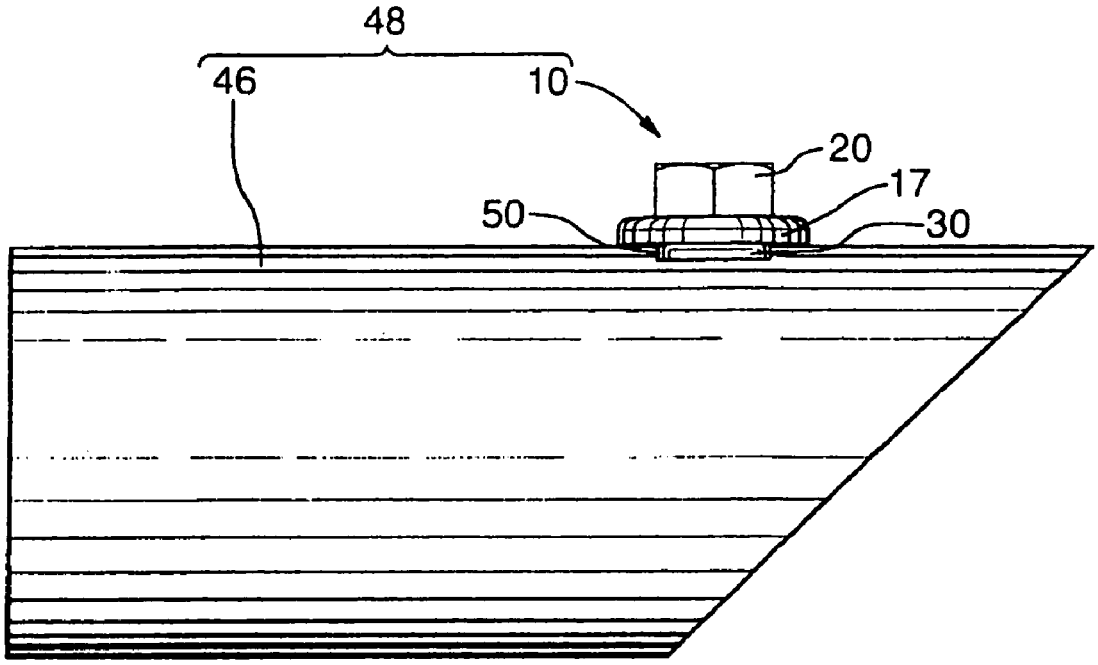
FIG. 3A is a side view of a guy guard assembly constructed according to a second preferred embodiment of the present invention.
Figure 3B:
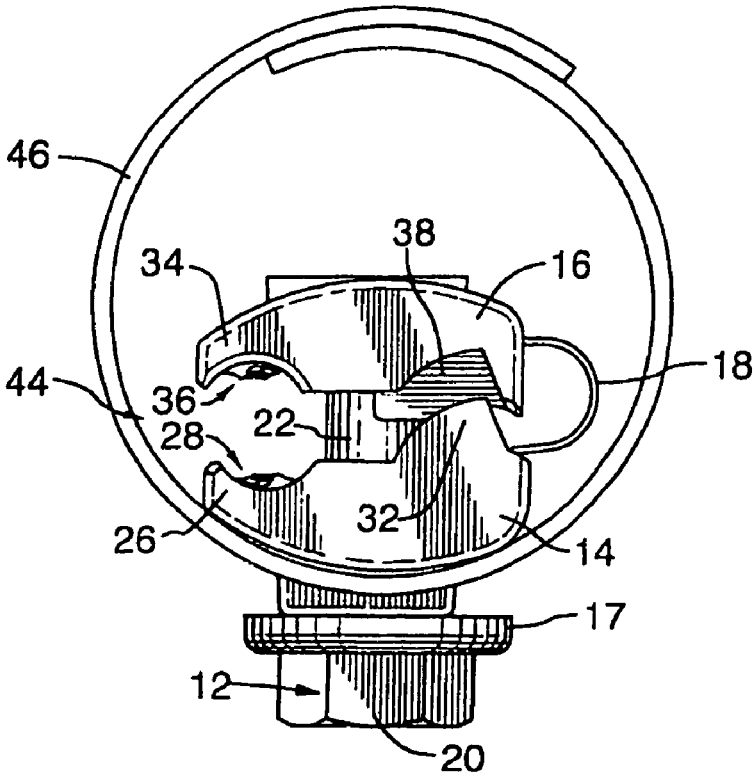
FIG. 3B is an end view of the guy guard assembly of FIG. 3A.

In FIGS. 3A, 3B, the clamp 10 is illustrated in use with a guy guard 46 to form a guy guard assembly 48. The guy guard 46 is in the form of a tube defined by a sheet of plastic formed in a roll. The tube wall has defined therethrough a square aperture 50, shown in phantom outline in FIG. 3A, which aperture defines a socket. In such use, the first clamp portion 14 is disposed inside the tube 46 against the tube wall and the boss 30 is mechanically engaged in the socket 50, such that the boss 30 defines lock means for securing the first clamp portion 14 as against rotation about the bolt axis relative to the tube 46.

Figure 4A:
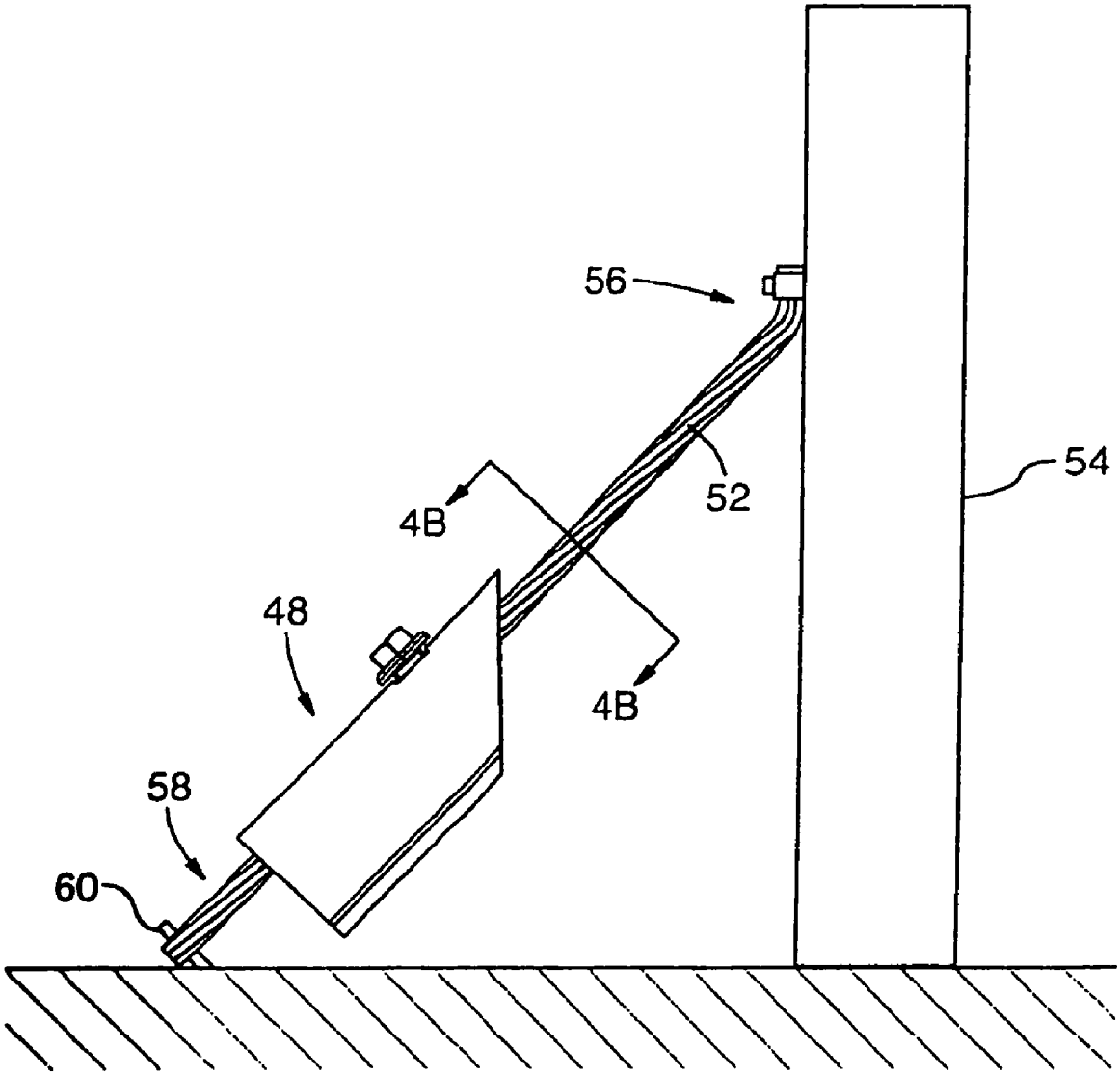
FIG. 4A is a side view of the guy guard assembly of FIG. 3A in use.
Figure 4B:
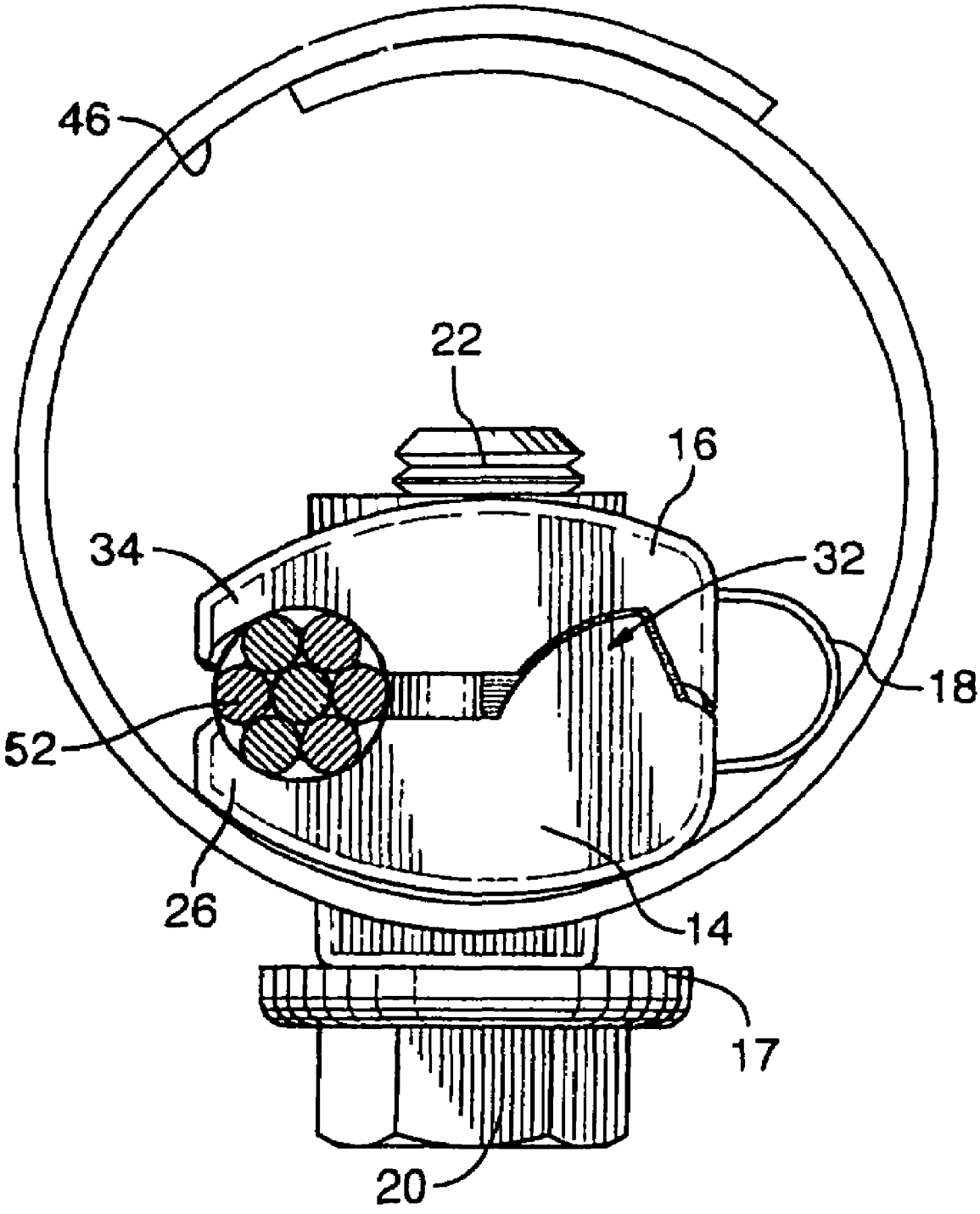
FIG. 4B is a view along section line 4B-4B of FIG. 4A.

FIGS. 4A, 4B show the structure of FIG. 3A in use with a guy wire 52 supporting a pole structure 54, with one end 56 of the guy wire 52 secured to the structure 54 and the other end 58 of the guy wire 52 secured to a ground-mounted stake 60.

To use the guy guard assembly of FIG. 3A with the guy wire of FIG. 4A, the plastic sheet forming the tube 46 is partially unrolled, and the tube 46 is spun over the wire, such that the tube wraps around the wire. Following this initial stage of installation, the guy wire 52 will typically lie outside the clamp 10 (not shown), but the jaw parts 26, 34 of the clamp 10 are separated from one another to define a slot 44, shown in FIG. 3B, into which the guy wire 52 can easily be slotted by an installer.

In the next step of installation, by manipulation of the guy guard assembly 48 and the guy wire 52, the guy wire 52 is slotted into the slot 44 (not shown).

Thereafter, the installer rotates the bolt 12 using a socket driver or similar tool, which causes the clamp portions 14,16 to assume the second configuration, wherein the jaw parts 26, 34 grip the guy wire 52, as shown in FIG. 4B, to immobilize the guy guard assembly 48. As evidenced in FIG. 4B, the guy wire 52 extends through the troughs 28, 36 of the jaw parts 26, 34 when the clamp portions 14,16 are disposed in the second configuration. The first 62 and second 64 grip members defined in the troughs are shaped so as fill the gap between 2 adjacent wires or strands of the guy wire 52. This increases surface area in contact, improving grip. As well, the grip members engage with the guy wire in the manner of a bolt with a nut, such that, generally, if the guy guard assembly 48 is to move along the length of the wire 52, it is constrained to move along a helical path, i.e. it must spiral. This minimizes the likelihood that the guy guard assembly 48 will be displaced by vandals or the like.

As shown, each grip member defines only a single "spline". Two or more splines could conceivably be defined by each grip member, which could yet further increase the surface area and gripping strength. However, additional splines render proper engagement between splines and wire more difficult, and also demands finer tolerances in terms of the guy wire used—where the helix followed by the splines does not match exactly the helix defined by the cable, the risk of poor engagement would be relatively high. A single, relatively short, spline is more likely to find engagement between strands in the guy wire. Without intending to be bound by theory, it is believed that a single, relatively short spline, may seat itself even in the context of not-perfectly matching wire/spline helixes, by flexing the strands in the guy wire and/or flexing itself. The short length of the splines does not substantially impair the gripping strength provided thereby, since in the preferred embodiment illustrated, the gripping force is focused or centred in the vicinity of the threaded bore.

While but two embodiments of the invention are herein shown and described, it is to be understood that various changes in size and shape of parts may be made. For example, whereas the boss and aperture shown are both square, it will be evident that other cross-sections, such as rectangular, could equally be employed with similar utility. Further, whereas the bias means illustrated comprises a pair of straps, it will be evident that greater or lesser number of straps could be utilized. As well, whereas a metallic bolt is described, bolts of plastic or composite material could be utilized. Additionally, whereas the disclosure describes clamp portions injection-molded out of 30% glass-filled nylon, other plastics and construction techniques could be employed. Further, whereas a washer is shown, the washer could be omitted, or formed as part of the bolt or the guard. Greater or lesser numbers of grip members in the troughs could be utilized. Lastly, but without limitation, whereas ears projecting from the first clamp portion and mechanically engaging opposite notches of the second clamp portion are employed to arrest rotation in the preferred embodiments, other mechanisms could be provided. Indeed, the straps themselves provide some functionality in this regard.

Accordingly, it should be understood that the invention is to be limited only by the claims appended hereto, purposively construed.

The invention claimed is:

1. A guy guard assembly for use with a guy wire of the type secured in use at one end to a structure to be supported and at the other end to the ground, the guy guard assembly comprising:

a guy guard in the form of a tube, the tube wall having an aperture defined therethrough; and a clamp including: a bolt having a head disposed outside the tube and a threaded shaft extending from the head through the aperture; a first plastic clamp portion disposed inside the tube against the tube wall and through which the bolt extends in spaced-relation, the first plastic clamp portion defining a first jaw part; and a second plastic clamp portion defining a second jaw part and threaded to the bolt, the clamp portions having a first configuration, wherein the jaw parts are relatively distal to and spaced apart from one another to define a slot in which said guy wire can be slotted, and, from the first configuration, being configurable through rotation of the bolt to a second configuration, wherein the jaw parts are relatively proximal to one another to grip said guy wire when disposed in said slot; and wherein the clamp further comprises bias means for biasing the clamp portions for movement toward the first configuration.

2. A guy guard assembly for use with a guy wire of the type secured in use at one end to a structure to be supported and at the other end to the ground, the guy guard assembly comprising:

a guy guard in the form of a tube, the tube wall having an aperture defined therethrough;

one or more resilient straps; and a clamp including: a bolt having a head disposed outside the tube and a threaded shaft extending from the head through the aperture; a first plastic clamp portion disposed inside the tube against the tube wall and through which the bolt extends in spaced-relation, the first plastic clamp portion defining a first jaw part; and a second plastic clamp portion defining a second jaw part and threaded to the bolt, the clamp portions having a first configuration, wherein the jaw parts are relatively distal to and spaced apart from one another to define a slot in which said guy wire can be slotted, and, from the first configuration, being configurable through rotation of the bolt to a second configuration, wherein the jaw parts are relatively proximal to one another to grip said guy wire when disposed in said slot; and each of said one or more resilient plastic straps is connected to each of the first clamp portion and the second clamp portion for biasing the clamp portions for movement toward the first configuration.

3. A guy guard assembly according to claim 2, further comprising lock means for securing the first clamp portion as against rotation about the bolt axis relative to the tube.

4. A guy guard assembly according to claim 3, wherein the aperture defines a socket and the first clamp portion has a protruding boss mechanically engaged in said socket and defining the lock means.

5. A guy guard assembly according to claim 4, wherein the aperture and the boss are both square.

6. A guy guard assembly according to claim 2, wherein the first clamp portion and the second clamp portion are formed from plastic that is substantially electrically non-conductive.

7. A guy guard assembly according to claim 2, wherein the first jaw part and the second jaw part respectively define opposed troughs of substantially semi-circular cross-section, through which the guy wire extends in use when the clamp portions are disposed in the second configuration.

8. A guy guard assembly according to claim 2, wherein a sheet of plastic formed in a roll defines the tube.

9. A guy guard assembly according to claim 7, wherein a pair of grip members is defined, one in each of said opposed troughs, said grip members engaging with the guy wire in the manner of a bolt with a nut.

10. A guy guard assembly for use with a guy wire of the type secured in use at one end to a structure to be supported and at the other end to the ground, the guy guard assembly comprising:

a guy guard in the form of a tube, the tube wall having an aperture defined therethrough; and a clamp including: a bolt having a head disposed outside the tube and a threaded shaft extending from the head through the aperture; a first plastic clamp portion disposed inside the tube against the tube wall and through which the bolt extends in spaced-relation, the first plastic clamp portion defining a first jaw part; and a second plastic clamp portion defining a second jaw part and threaded to the bolt, the clamp portions having a first configuration, wherein the jaw parts are relatively distal to and spaced apart from one another to define a slot in which said guy wire can be slotted, and, from the first configuration, being configurable through rotation of the bolt to a second configuration, wherein the jaw parts are relatively proximal to one another to grip said guy wire when disposed in said slot; and wherein the first clamp portion has a pair of projecting ears mechanically engaging opposite notches of the second clamp portion for arresting relative rotation of the first clamp portion and the second clamp portion.

11. A clamp for use with a guy guard tube of the type through which a guy wire extends in use and having an aperture defined through the tube wall, the clamp including:

a bolt having a head disposed in use outside said guy guard and a threaded shaft extending from the head through said aperture in use;

a first plastic clamp portion disposed in use inside the tube against the tube wall and through which the bolt extends in spaced relation, the first plastic clamp portion defining a first jaw part; and a second clamp portion defining a second jaw part and threaded to the bolt, the clamp portions having a first configuration, wherein the jaw parts are relatively distal to and spaced apart from one another to define a slot in which said guy wire can be slotted, and, from the first configuration, being configurable through rotation of the bolt to a second configuration, wherein the jaw parts are relatively proximal to one another to grip said guy wire when disposed in said slot and further comprising one or more resilient plastic straps, each of said one or more resilient plastic straps being connected to each of the first clamp portion and the second clamp portion for biasing the clamp portions for movement toward the first configuration.

12. A clamp according to claim 11, wherein the first clamp portion and the second clamp portion are formed from plastic that is substantially electrically non-conductive.

13. A clamp according to claim 11, wherein the first jaw part and the second jaw part respectively define opposed troughs of substantially semi-circular cross-section, through which the guy wire extends in use when the clamp is disposed in the second configuration.

14. A clamp according to claim 11, further comprising arresting means for arresting relative rotation of the first clamp portion and the second clamp portion.

15. A clamp according to claim 14, wherein the first clamp portion has a pair of projecting ears mechanically engaging opposite notches of the second clamp portion and defining the arresting means.

16. A clamp for use with a guy guard tube of the type through which a guy wire extends in use and having an aperture defined through the tube wall, the clamp comprising:

a bolt having a head disposed in use outside said guy guard tube and a threaded shaft extending from the head through said aperture in use;

a first clamp portion and a second clamp portion, the first clamp portion being disposed in use inside the tube against the tube wall and through which the bolt extends in spaced relation, the first clamp portion defining a first jaw part and the second clamp portion defining a second jaw part and threaded to the bolt, the clamp portions having a first configuration, wherein the jaw parts are relatively distal to and spaced apart from one another to define a slot in which said guy wire can be slotted, and, from the first configuration, being configurable through rotation of the bolt to a second configuration, wherein the jaw parts are relatively proximal to one another to grip said guy wire when disposed in said slot; and bias means for biasing the clamp portions for movement toward the first configuration.

17. A clamp according to claim 16, further comprising:

lock means for securing, in use, the first clamp portion as against rotation about the bolt axis relative to the tube; and arresting means for arresting relative rotation of the first clamp portion and the second clamp portion such that, with the clamp portions in the first configuration, the jaw parts of the clamp are separated from one another to define a slot into which said guy wire can be slotted by an installer in use.

* * * * *